US006145621A

United States Patent [19]

Nye

[11] Patent Number: 6,145,621

[45] Date of Patent: Nov. 14, 2000

[54] BOARDING LADDER FOR A BOAT BOW

[76] Inventor: John E. Nye, 8128 Causeway Blvd., St. Pete Beach, Fla. 33707

[21] Appl. No.: 08/926,087

[22] Filed: Sep. 2, 1997

[51] Int. Cl.[7] ..... E06C 1/00

[52] U.S. Cl. ..... 182/159; 182/160; 182/220; 182/228.1

[58] Field of Search ..... 182/159, 160, 182/220, 162, 228.1, 228.2, 228.3, 228.4, 228.5, 228.6

[56] References Cited

U.S. PATENT DOCUMENTS

| | | | |
|---|---|---|---|
| D. 258,148 | 2/1981 | Loix . | |
| 292,150 | 1/1884 | Work | 182/159 |
| 314,438 | 3/1885 | Dennis | 182/159 |
| 341,284 | 5/1886 | Sharp | 182/159 |
| 732,295 | 6/1903 | Gustapson . | |
| 1,085,563 | 1/1914 | Garraway | 182/160 |
| 1,232,221 | 7/1917 | Chesebro . | |
| 1,314,201 | 8/1919 | Moore . | |
| 1,557,490 | 10/1925 | Videtta . | |
| 1,606,445 | 11/1926 | Pirsch | 182/159 X |
| 2,875,935 | 3/1959 | Buttermore | 228/36 |
| 2,981,364 | 4/1961 | Webber | 182/159 |
| 2,992,697 | 7/1961 | Klages | 182/228.2 X |
| 3,077,241 | 2/1963 | Klages | 182/228.2 X |
| 3,498,410 | 3/1970 | Storch | 182/96 |
| 3,722,622 | 3/1973 | Lauring | 182/159 |
| 3,944,024 | 3/1976 | Adas | 182/194 |
| 4,231,448 | 11/1980 | Jensen | 182/93 |
| 4,463,829 | 8/1984 | Grin | 182/160 |
| 4,716,988 | 1/1988 | Graffy | 182/194 X |
| 4,785,912 | 11/1988 | Lopez | 182/160 |
| 5,170,862 | 12/1992 | Chang | 182/159 |

FOREIGN PATENT DOCUMENTS

| | | | |
|---|---|---|---|
| 137708 | 6/1930 | Switzerland | 182/159 |

*Primary Examiner*—Daniel P. Stodola
*Assistant Examiner*—Bruce A. Lev
*Attorney, Agent, or Firm*—Harold D. Shall

[57] ABSTRACT

A foldable ladder suitable for boarding a boat from the bow end thereof having laterally spaced side rails each with upper and lower portions. The upper and lower portion of one side rail are hinged together or pivoting in an outward direction and the upper and lower portions of the other side rails include a releasable connection. A plurality of steps extend between the side rails and are connected at their ends to the adjacent side rail by hinges. A releasable latch mechanism interconnects the side rails for holding the ladder in its unfolded condition.

1 Claim, 4 Drawing Sheets

BOARDING LADDER FOR A BOAT BOW

BACKGROUND OF THE INVENTION

1. Field of the Invention

This invention relates to boarding ladders in general, and more specifically to ladders suitable for boarding the bow end of a boat which has been beached bow first and wherein such ladder can be folded to a size convenient for compact storage.

2. Description of Prior Art

There are numerous folding ladders shown in the prior art. For example, U.S. Pat. No. 4,785,912 shows a folding ladder wherein the rungs are pivoted at their ends to the sides of the ladder so that the ladder can be collapsed endwise. This construction provides for a ladder which can be condensed laterally, but in so doing, the length of the ladder is increased. Such is also the case with the ladder of U.S. Pat. No. 4,463,829, wherein in FIG. 1, it is seen that the length thereof is increased when it is "folded". This is also the case with U.S. Pat. Nos. 1,232,221, 2,875,935, 3,498,410, 3,722,622 and Design U.S. Pat. No. 258,148. U.S. Pat. No. 341,284 shows a ladder which folds laterally about the pivots of the steps to the side rails and which side rails also pivot to provide the compact structure of FIG. V. However, since the wide side rails A and A' rest upon each other when the device is folded so that the width of the ladder effectively becomes double its unfolded width when extended, this folded configuration is not fully desirable. This is also the case with ladders of U.S. Pat. Nos. 732,295 and 1,314,201.

SUMMARY OF THE INVENTION

It is, therefore, an object of this invention to provide a foldable ladder wherein the steps fold relative to the side rails to condense the width of the ladder, but also wherein the side rails fold relative to each other in a lateral direction so that the side rails do not stack on top of each other in their thick direction and become excessively thick.

DETAILED DESCRIPTION OF THE PREFERRED EMBODIMENT

Figure 4:
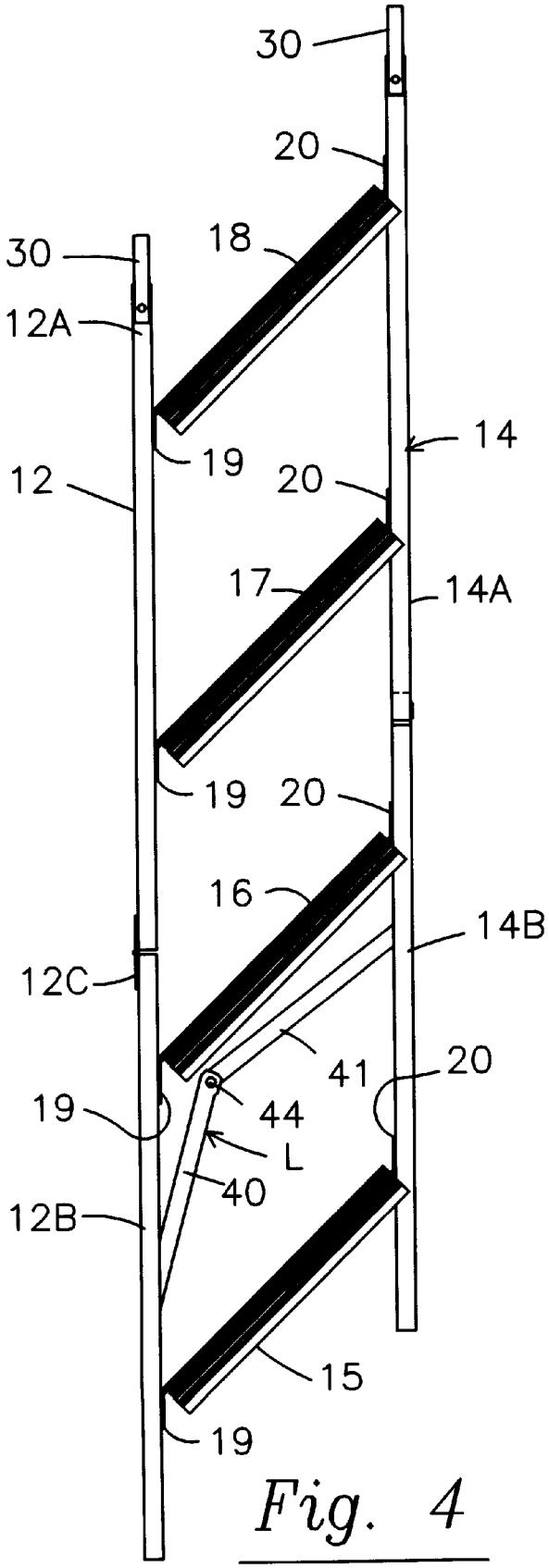
FIG. 4 is a view like FIG. 1 with the ladder partially folded.

Referring now to the drawings, a foldable ladder is shown generally at 10 and includes a left and a right vertically extending and laterally spaced side rail, 12 and 14 respectively connected by four laterally extending steps, bottom step 15, next 16, next 17 and top step 18. Each of the steps 15, 16, 17 and 18 are pivotally connected at its left end by a hinge 19 to the inner side of the left rail 12, as seen in FIG. 4, which hinges allow the steps to pivot upwardly relative to the left rail and, are each pivotally connected at its right end by a hinge 20 (see FIGS. 2 and 4) which hinges allow the steps to pivot downwardly relative to the right rail 14. The side rail 12 has upper and lower portions 12A and 12B and the side rail 14 has upper and lower portions 14A and 14B.

As seen in FIGS. 2, 5, 6 and 7, the front edges 21 of the steps 15, 16, 17 and 18 are curved arcuately downwardly so that when the ladder is folded, the arcuate portion 21 of the steps will overly the adjacent edge of the upper and lower rail portions 14A and 14B of the rail 14, while the top of each step will lie flat against the inner side of the upper 12A and lower 12B portions of the side rail 12.

Figure 1:
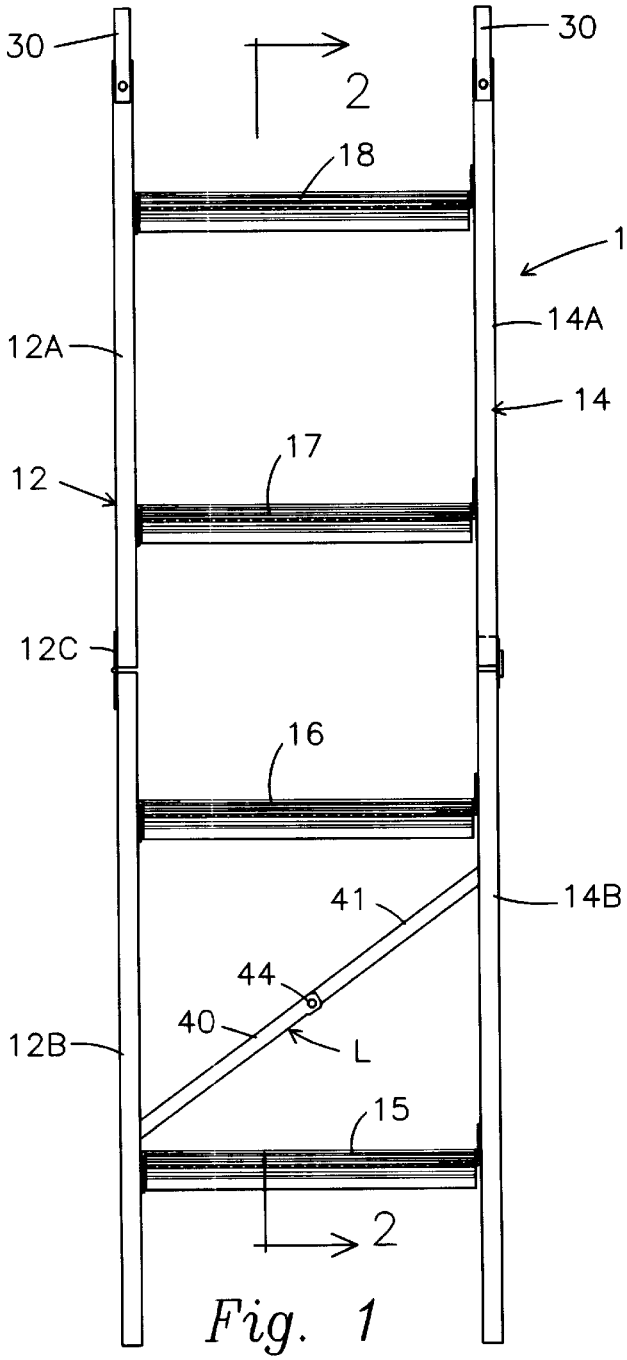
FIG. 1 is a front elevational view of a ladder according to this invention.
Figure 2:
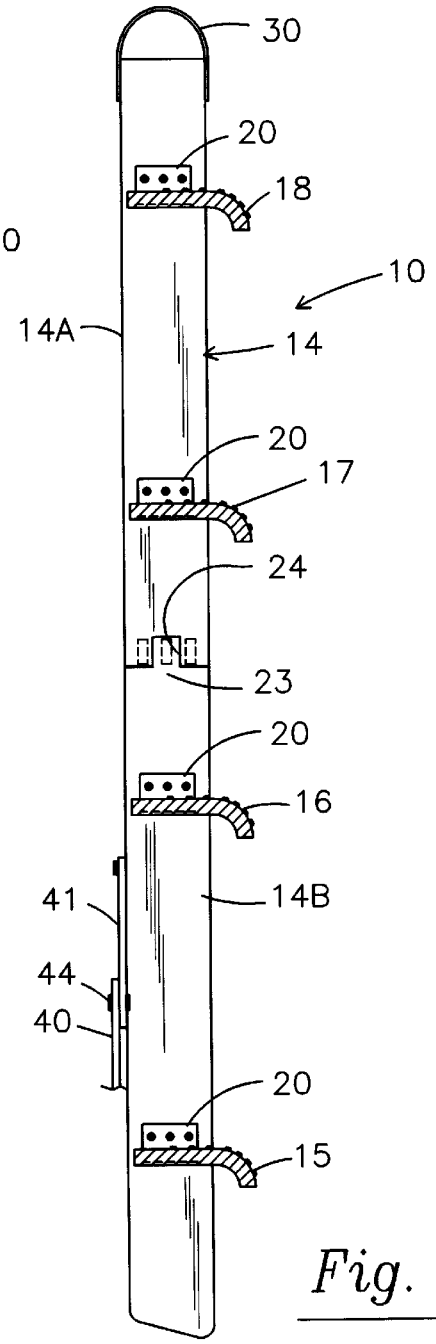
FIG. 2 is a cross sectional view taken along the lines 2—2 in FIG. 1.
Figure 3:
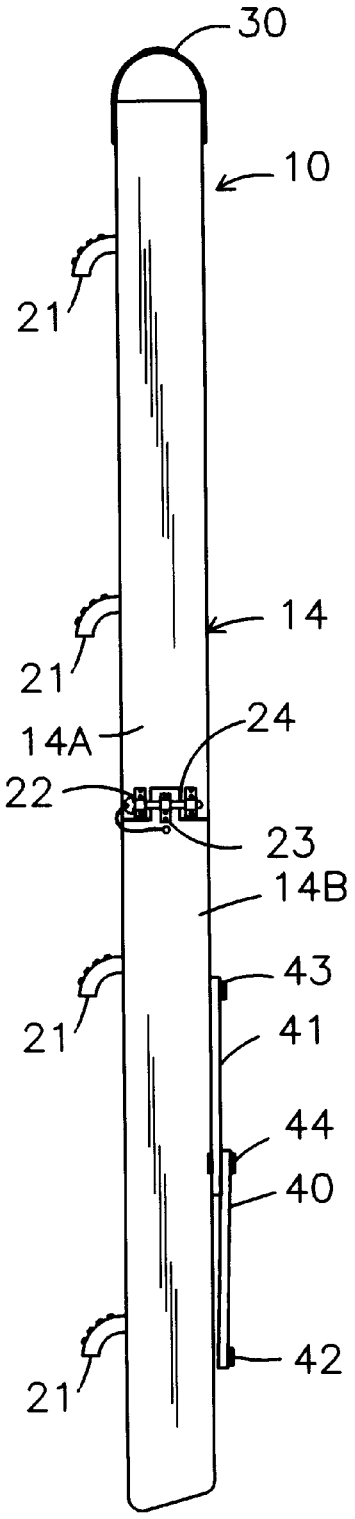
FIG. 3 is a right side elevational view of the ladder of FIG. 1.
Figure 8:
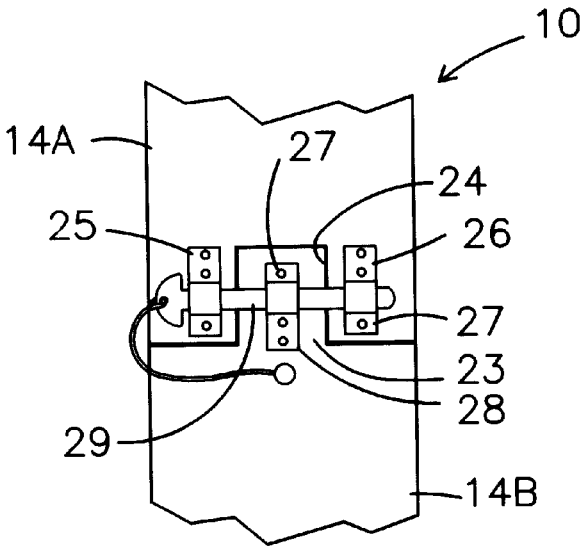
FIG. 8 is an enlarged view of the latching device shown by the letter A in FIG. 3.

In FIGS. 1–3, the ladder 10 is shown in its upright operative condition with a latch 22 rigidly securing the upper 14A and lower 14B portions of the side rail 14 together to thereby make the ladder functional; the portions 14A and 14B being of substantially equal length. The latch 22 may take many suitable configurations, but as seen in FIG. 8 a very suitable one includes a tongue 23 on the lower portion 14B of the side rail 14 snugly received in a groove or slot 24 in the top portion 14A. A pair of latch members 25 and 26 are disposed one on each side of the slot 24, and are securely fixed to the upper portion 14A by a plurality of rivets 27 with the members having a laterally extending aligned opening therein (not shown). The tongue 23 has a latch member 28 secured thereto by a plurality of rivets 27, which member 28 has a laterally extending opening therein (not shown). A latch pin 29 extending through the aligned openings in the latch members 25, 26 and 28 to thereby securely lock the upper and lower portions 14A and 14B together in a single functional piece. The pin 29 is secured to the member 14B by a conventional cord to prevent the loss thereof when removed from the latch members.

Figure 6:
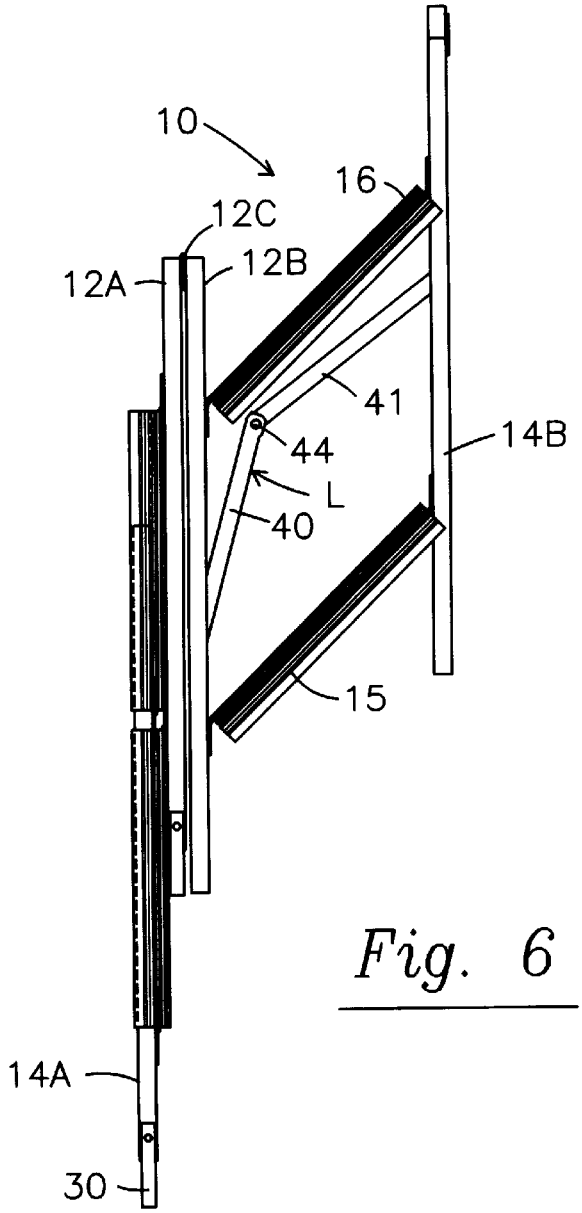
FIG. 6 is a view like FIG. 5 with the ladder still further folded.

The substantially equally lengthed upper 12A and lower 12B, portions of the left rail 12 are joined by a hinge 12C which hinge, as seen in FIG. 6, allows the upper portion 12A to move counterclockwise relative to the portion 12B and thus lie flat thereagainst.

A latch mechanism shown generally at L is provided to hold the ladder to it is unfolded operative position shown in FIG. 1. The latch L has lower and upper portions 40 and 41, respectively which are interconnected by a pivot pin 44. The lower portion 40 is connected by a screw 42 to the side rail portion 12B. The overlapping ends of the portions 40 and 41 of the latch L have a conventional detent means therein to releasably lock them in their aligned extended position of FIG. 1 while being releasable to allow the side rails to come together laterally.

Figure 5:
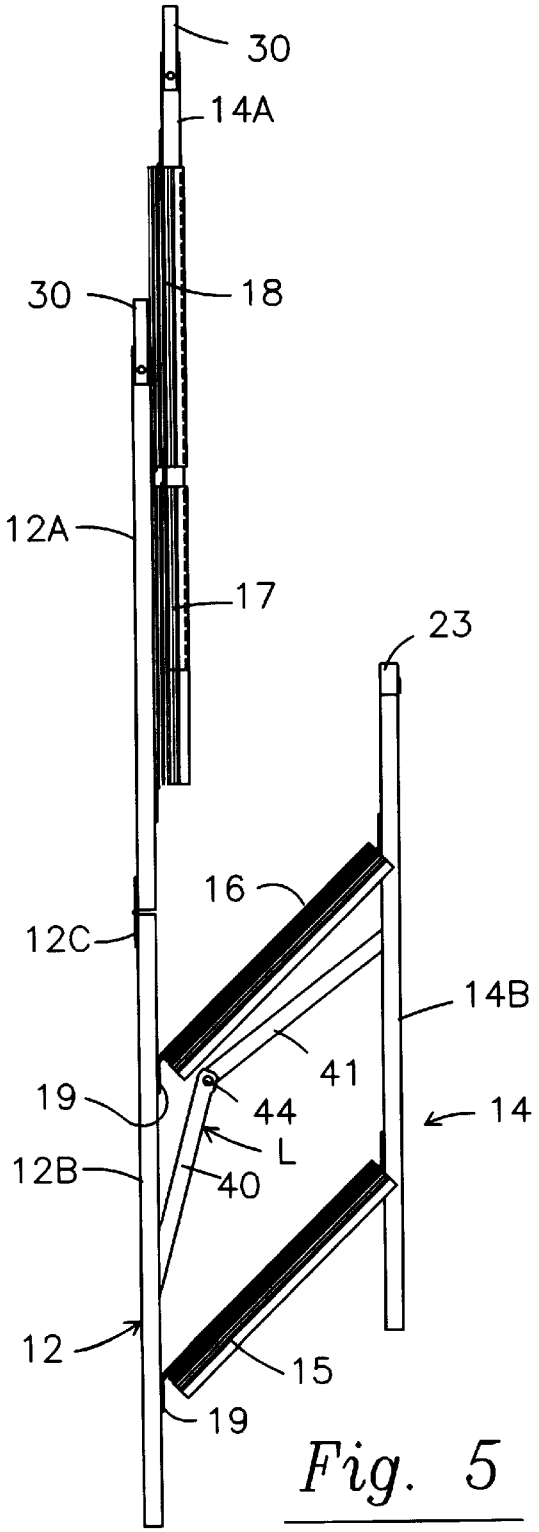
FIG. 5 is a view like FIG. 4 with the ladder further folded.

As seen in FIG. 5, to completely fold the ladder 10, the latch pin 29 is removed from the latch members 25, 26 and 28, the latch mechanism L is released and the portion 14A is fold up against the portion 12A. As seen in FIG. 6, the portion 12A is then folded down against the portion 12B around the hinge 12C with the steps 17 and 18 being therebetween and the front edges of the steps 17 and 18 overlying the portion 14A. The portion 14B is then folded upwardly to the portion 12B with the steps 15 and 16 being therebetween and the front edges of the steps 15 and 16 overlying the portion 14B.

Figure 7:
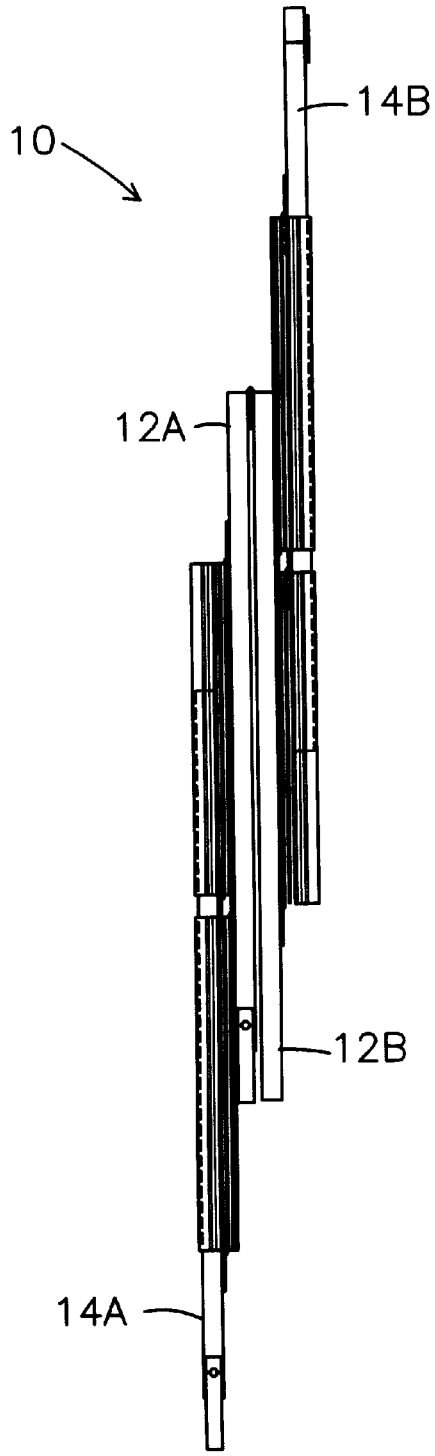
FIG. 7 is a view like FIG. 6 showing the ladder completely folded.

In this folded position the ladder 10 is very compact and can easily be stored in a boat or otherwise. Since the load on the side rails when someone is climbing on the same, is greatest in a direction to bend the same fore and aft, as seen in FIG. 2, the rails are made thicker in this direction. This "thicker portion" is not stacked one upon each other when the ladder is folded, as seen in FIG. 7, so that the ladder takes much less room than if the ladder were folded with its thicker portions stacked as seen in U.S. Pat. Nos. 732,295, 1,314,201 and 1,557,490.

When in its position shown in FIGS. 1–3, the top of the side rails 12 and 14 each has an arcuate carrying handle 30 secured thereto, and as seen in FIG. 7, when the ladder 10 is completely folded, the handle 30 on the portion 14A is available for carrying purposes. Since this ladder is adapted for boarding the bow of a boat, suitable protection strips can be secured to the back of portions 12A and 14B to protect the ladder and the bow of the boat.

Although the above description relates to a presently preferred embodiment, numerous changes can be made therein without departing from the scope of this invention as claimed in the following claims.

What is claimed is:

1. A foldable ladder having a folded and an operative unfolded condition and when unfolded being suitable for boarding the bow of a beached boat comprising in combination, (a) a pair of laterally spaced vertically extending side rails each having a lateral width and a wider depth and with the lateral width of said side rails being less than the wider depth thereof, (b) a plurality of laterally extending steps extending laterally between said side rails when said ladder is in its operative unfolded condition with each end of each of said steps adjoining a side rail, (1) said side rails having an inside surface and said steps having laterally opposed ends with each end thereof including one directional folding hinge means connecting said end to the inside surface of the adjoining side rail, (c) each of said side rails being formed of an upper and lower portion, which upper and lower portions are substantially equal in length, (1) one of said side rails including latch means interconnecting the adjacent ends of said upper and lower portion thereof when said ladder is in its unfolded operative condition, with said latch means being disconnectable to allow the ladder to be folded and structural features within said hinge means connecting said ends of said steps to said inside surface of said one of said side rails allows said steps to move only downwardly to said one side rail, when said ladder is being folded, and said hinge means including a pair of opposed pivotally connected flaps, with one of said flaps being connected to said one side rail at a location solely above said steps and the other of said flaps being connected to said at a location solely on the underside thereof, (2) the other of said side rails having said upper and lower positions thereof hinged together whereby said upper portion thereof can pivot in a direction away from said upper portion of the other side rail to a position wherein the wider outer surfaces of said upper and lower portion of said other side rail lay against each other and said hinge means connecting said ends of said steps to said inside surface of said other of said rails allows said steps to move only upwardly relative to said other of said side rails when said ladder is being folded, and said hinge means including a pair of opposed pivotally connected flaps, with one of said flaps being connected to said other side rail at a location solely below said steps and the other of said flaps being connected to said step at a location solely on the upper side thereof, (3) the upper portion of said one side rail being foldable against said upper portion of said other side rail and said lower portion of said one side rail being foldable against said lower portion of said other side rail with their wider inner surfaces adjacent each other and said steps folded therebetween, and (d) a releasable latch mechanism having a released and an engaged position connecting said side rails for alternately holding said side rails in their laterally spaced relationship when engaged and when released allowing said side rails to move to their folded condition, (1) the direction of folding of said hinge means being independent of said latch mechanism, and (e) said pivotally connected flaps of said hinge means having a ladder unfolded position wherein said flaps are disposed ninety degrees from each other and a ladder folded position wherein said flaps are disposed one hundred and eighty decrees from each other, (f) said steps have a depth which is greater than the width of said side rails and a projecting portion thereof projects beyond said side rails the entire lower surface of said projecting portion being curved arcuately so that when said ladder is folded said arcuate portion overlies said other side rail.

* * * * *